US009567800B1

(12) United States Patent
Newport et al.

(10) Patent No.: US 9,567,800 B1
(45) Date of Patent: Feb. 14, 2017

(54) DECK CURTAIN SYSTEM AND METHOD OF USE

(71) Applicants: Cheryl Newport, Davenport, IA (US); David D. Heilman, Geneseo, IL (US)

(72) Inventors: Cheryl Newport, Davenport, IA (US); David D. Heilman, Geneseo, IL (US)

(73) Assignee: Deck Dressings, LLC, Davenport, IA (US)

( * ) Notice: Subject to any disclaimer, the term of this patent is extended or adjusted under 35 U.S.C. 154(b) by 72 days.

(21) Appl. No.: 14/577,147

(22) Filed: Dec. 19, 2014

Related U.S. Application Data

(60) Provisional application No. 61/918,604, filed on Dec. 19, 2013.

(51) Int. Cl.

| | |
|---|---|
| ***A47H 3/00*** | (2006.01) |
| ***E06B 9/24*** | (2006.01) |
| ***E04B 1/00*** | (2006.01) |
| ***E04B 5/02*** | (2006.01) |
| ***E04B 1/19*** | (2006.01) |

(52) U.S. Cl.
CPC ..... *E06B 9/24* (2013.01); *E04B 1/003* (2013.01); *E04B 1/19* (2013.01); *E04B 5/02* (2013.01); *E04C 2/50* (2013.01)

(58) Field of Classification Search
CPC ..... A47H 1/142; E06B 9/24; E04B 1/003; E04B 1/19
USPC .. 160/330, 333–339, 351, 350, 135; 135/90, 116, 118, 120.1–120.3, 121, 141; 248/536, 125.7, 125.8, 125.9
See application file for complete search history.

(56) References Cited

U.S. PATENT DOCUMENTS

| | | | | | |
|---|---|---|---|---|---|
| 443,133 | A * | 12/1890 | Connelly | A47H 1/122 | 160/338 |
| 1,015,448 | A * | 1/1912 | Madden | A47B 47/027 | 211/182 |
| 1,371,524 | A * | 3/1921 | Smith, Jr. | E06B 9/54 | 160/237 |
| 2,014,752 | A * | 9/1935 | Vesey | A47H 5/02 | 160/126 |
| 2,104,416 | A * | 1/1938 | De Ment | A47G 5/00 | 135/142 |
| 2,745,420 | A * | 5/1956 | Zitomer | E06B 9/52 | 135/117 |

(Continued)

OTHER PUBLICATIONS

Improvements "Railing Curtain Rod and 2 Posts" <http://www.improvementscatalog.com/railing-curtain-rod-and-2- posts/318909>.*

(Continued)

*Primary Examiner* — Katherine Mitchell
*Assistant Examiner* — Johnnie A Shablack
(74) *Attorney, Agent, or Firm* — Hamilton IP Law, PC; Jay R. Hamilton; Charles A. Damschen

(57) ABSTRACT

A deck curtain and mounting system using vertical posts attachable to a deck rail or decking form a structure supporting curtains hung from cross members positioned between the vertical posts to surround or encompass a deck area. The method of shading or securing the privacy of a deck area includes attaching vertical posts to a rail cap of a deck structure surrounding a deck area and attaching rotatable horizontal connectors to the vertical posts so that cross members may be connected between the vertical posts for hanging privacy curtains from the cross members around the deck structure.

13 Claims, 14 Drawing Sheets

(56) References Cited

U.S. PATENT DOCUMENTS 3,106,931 A * 10/1963 Cooper ..... B63B 17/04 114/361
3,656,494 A * 4/1972 Cornett ..... E04H 15/60 135/114
3,771,767 A * 11/1973 Dougherty ..... E04H 17/24 256/11
4,091,857 A 5/1978 Jacobs
4,300,253 A * 11/1981 Anderson ..... B63B 17/02 114/361
4,427,021 A * 1/1984 Cater, Sr. ..... E04H 15/48 135/116
4,683,901 A * 8/1987 Mitchell ..... E04H 6/00 114/263
4,698,117 A * 10/1987 Enison ..... A47G 11/006 156/486
4,794,974 A * 1/1989 Melino ..... E04G 21/243 160/327
4,831,791 A * 5/1989 Ball ..... A47B 83/001 160/135
4,901,484 A 2/1990 Santosuosso
5,352,149 A * 10/1994 Melashenko ..... A47G 5/00 160/135
5,415,194 A * 5/1995 Kaye ..... E04H 15/003 135/115
5,421,394 A * 6/1995 Forrest ..... A47H 7/00 160/349.2
5,472,102 A * 12/1995 Clayton ..... A47H 1/142 160/350
5,613,543 A * 3/1997 Walton ..... E04G 5/12 135/119
5,680,893 A 10/1997 Neer
5,884,725 A * 3/1999 Reyland ..... E04G 1/15 182/113
6,006,811 A * 12/1999 Brutsaert ..... E04F 10/0603 135/141
6,513,566 B2 * 2/2003 Larin ..... E04F 10/04 160/265
6,942,002 B1 * 9/2005 Williams ..... A47H 21/00 160/265
7,231,954 B2 * 6/2007 Green ..... E01F 13/022 135/114
7,316,237 B2 * 1/2008 Connelly ..... E04H 15/58 135/117
7,472,666 B1 * 1/2009 Richard ..... B63B 17/02 114/361
7,594,633 B2 * 9/2009 Carnevali ..... F16M 11/04 248/125.9
7,673,643 B2 * 3/2010 Seo ..... E04H 15/32 135/120.1
7,703,469 B2 * 4/2010 Danziger ..... E04H 15/50 135/120.3
7,832,454 B2 11/2010 Lyons
7,856,761 B2 * 12/2010 Heselden ..... E04H 9/10 135/122
7,896,015 B2 * 3/2011 Milano, Jr. et al. .... E04H 15/06 135/117
8,393,343 B2 * 3/2013 VanVonderen ..... E04F 11/181 135/16
8,950,723 B1 * 2/2015 Fogelstrom ..... A45B 11/00 135/16
2001/0022217 A1 * 9/2001 Larin ..... E04F 10/04 160/351
2003/0094827 A1 * 5/2003 Faludy ..... B60P 3/36 296/26.06
2005/0230067 A1 * 10/2005 Jordan ..... E06B 9/521 160/330
2007/0034758 A1 * 2/2007 Bates ..... E04H 12/2276 248/218.4
2007/0108363 A1 * 5/2007 Metheny ..... A45B 11/00 248/539
2007/0235068 A1 * 10/2007 Green ..... E01F 13/022 135/114
2007/0235151 A1 * 10/2007 Stull ..... E06B 11/04 160/351
2008/0000504 A1 * 1/2008 Snyder ..... B08B 17/00 134/104.2
2008/0283106 A1 * 11/2008 Heselden ..... E04H 9/10 135/124
2013/0008617 A1 * 1/2013 Rivera ..... E04H 15/005 160/127
2013/0233365 A1 * 9/2013 Loos ..... E04H 15/005 135/114
2014/0075851 A1 * 3/2014 Rhines ..... E04B 2/72 52/63
2014/0116488 A1 * 5/2014 Mallookis ..... E04H 15/50 135/145
2016/0040477 A1 * 2/2016 Seuberling ..... E06B 9/52 52/656.7
2016/0108638 A1 * 4/2016 Loos ..... E04H 15/005 135/114

OTHER PUBLICATIONS

Improvements "Railing Curtain Rod and 2 Posts Item #448425" <http://www.improvementscatalog.com/wcsstore/images/Improvements/text/pdf/products/448425-Railing-Curtain-Rod-w2-Postpdf>.*

* cited by examiner

DECK CURTAIN SYSTEM AND METHOD OF USE

CROSS REFERENCE TO RELATED APPLICATIONS

This application claims priority from provisional U.S. Pat. App. No. 61/918,604 filed on Dec. 19, 2013, which is incorporated by reference herein in its entirety.

FIELD OF THE INVENTION

The present disclosure relates to a structure and method of placement of curtains, shades or sheers upon and around an outdoor deck for privacy and/or as a sunscreen.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.171 (D)(C)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

DETAILED DESCRIPTION - LISTING OF ELEMENTS

| Element Description | Element Number |
|---|---|
| Deck | 1 |
| Deck area | 2 |
| Decking | 3 |
| Decking member | 3a |
| Gap | 3b |
| Joist | 4 |
| Rail post | 5 |
| Picket | 6 |
| Horizontal members | 7 |
| Rail cap | 8 |
| Deck curtain system | 10 |
| Vertical post | 20 |
| Open end | 20a |
| Base end | 20b |
| End cap | 21 |
| Opening (threaded) | 22 |
| Finial | 23 |
| Threaded post | 23a |
| Adjustable section | 24 |
| Holes | 25 |
| Spring button latch | 26 |
| Main section | 27 |
| Cross bar | 30 |
| Open end | 30a |
| End cap | 31 |
| Opening (threaded) | 32 |
| Telescoping end section | 34 |
| Main section | 37 |
| Mounting base | 40 |
| Receiver | 41 |
| Opening | 41a |
| Base | 42 |
| Hanger | 43 |
| Vertical section | 43a |
| Horizontal shelf | 43b |
| Aperture | 47 |
| Fastener | 48 |
| Horizontal connector | 50 |
| Mount | 51 |
| Aperture | 51a |
| Flap | 52 |
| Aperture | 52a |

-continued

| DETAILED DESCRIPTION - LISTING OF ELEMENTS | |
|---|---|
| Element Description | Element Number |
| Post (threaded) | 53 |
| Knob | 54 |
| Curtain | 60 |
| Curtain entry-sleeve | 61 |
| Curtain top | 62 |
| Curtain bottom | 63 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

ILLUSTRATIVE EMBODIMENT AND ADVANTAGES OF INVENTION

Figure 1:
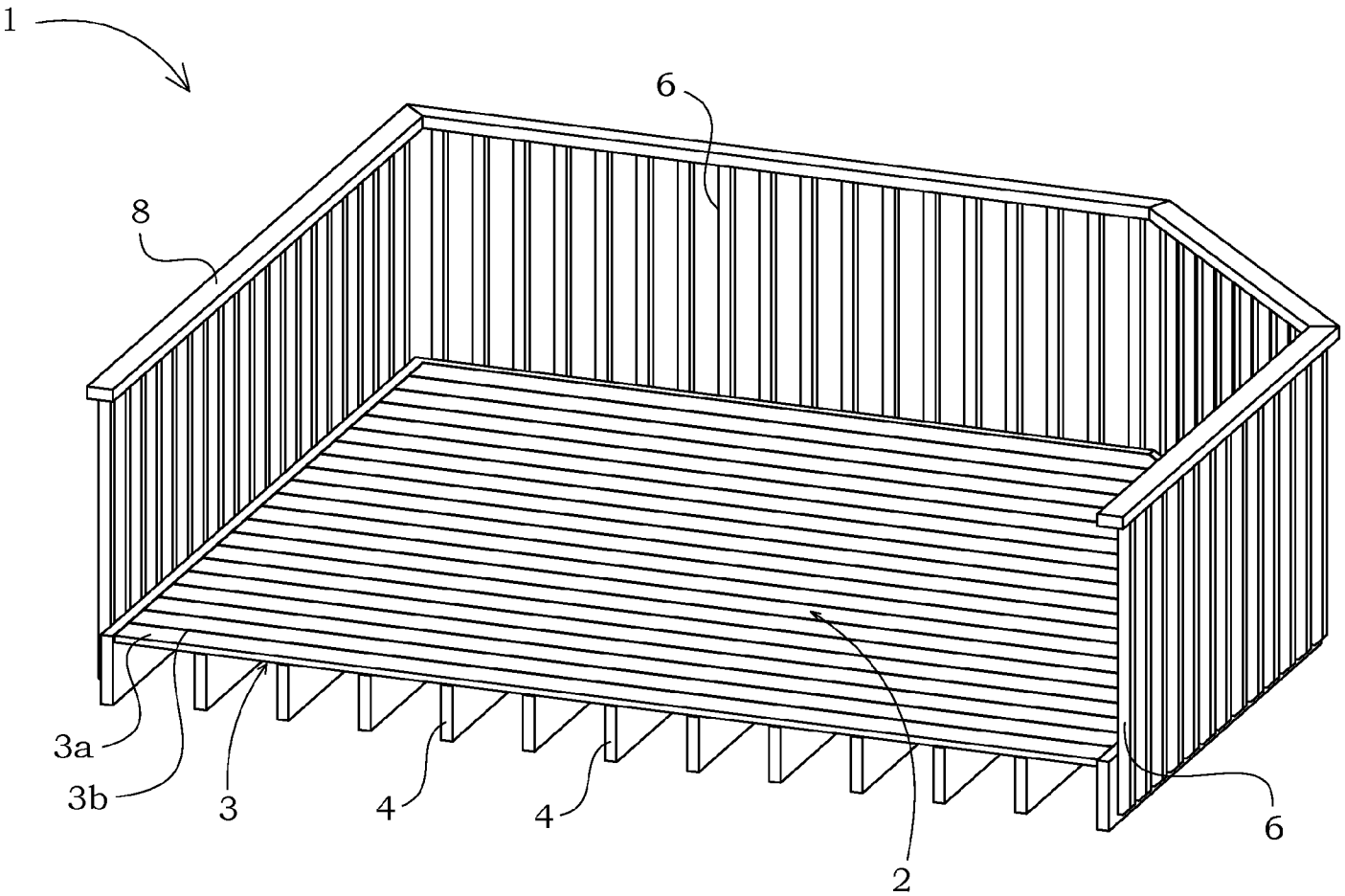
FIG. 1 is a perspective view of a deck 1 a surrounding an exterior space as may be attached to a residential home or apartment of the prior art.

FIG. 1 is a perspective view of a deck 1 a surrounding an exterior space as may be attached to a residential home or apartment of the prior art. The deck 1 of FIG. 1 is illustrative of those well known to those of ordinary skill in the art constructed with adjacent decking members 3*a* and gaps 3*b* to form decking 3 across joists. A rail cap 8 positioned on rail posts 5 and vertical pickets 6 define the perimeter of the deck 1 creating the deck area 2. Although not shown, additional horizontal members 7 may be affixed to the outer joists and or the pickets for added strength. As illustrated in FIGS. 2-10, it is an object of the invention to disclose a system allowing for enclosure of a deck 1 similar to that disclosed in FIG. 1 without regard to the deck area 2 or the outline of the perimeter formed by the rail cap 8. As will be discussed herein, one of ordinary skill will appreciate that the deck curtain system 10 and its method of use will vary from that shown in FIG. 1 without departure from the spirit and intent of the invention disclosed herein.

Figure 2:
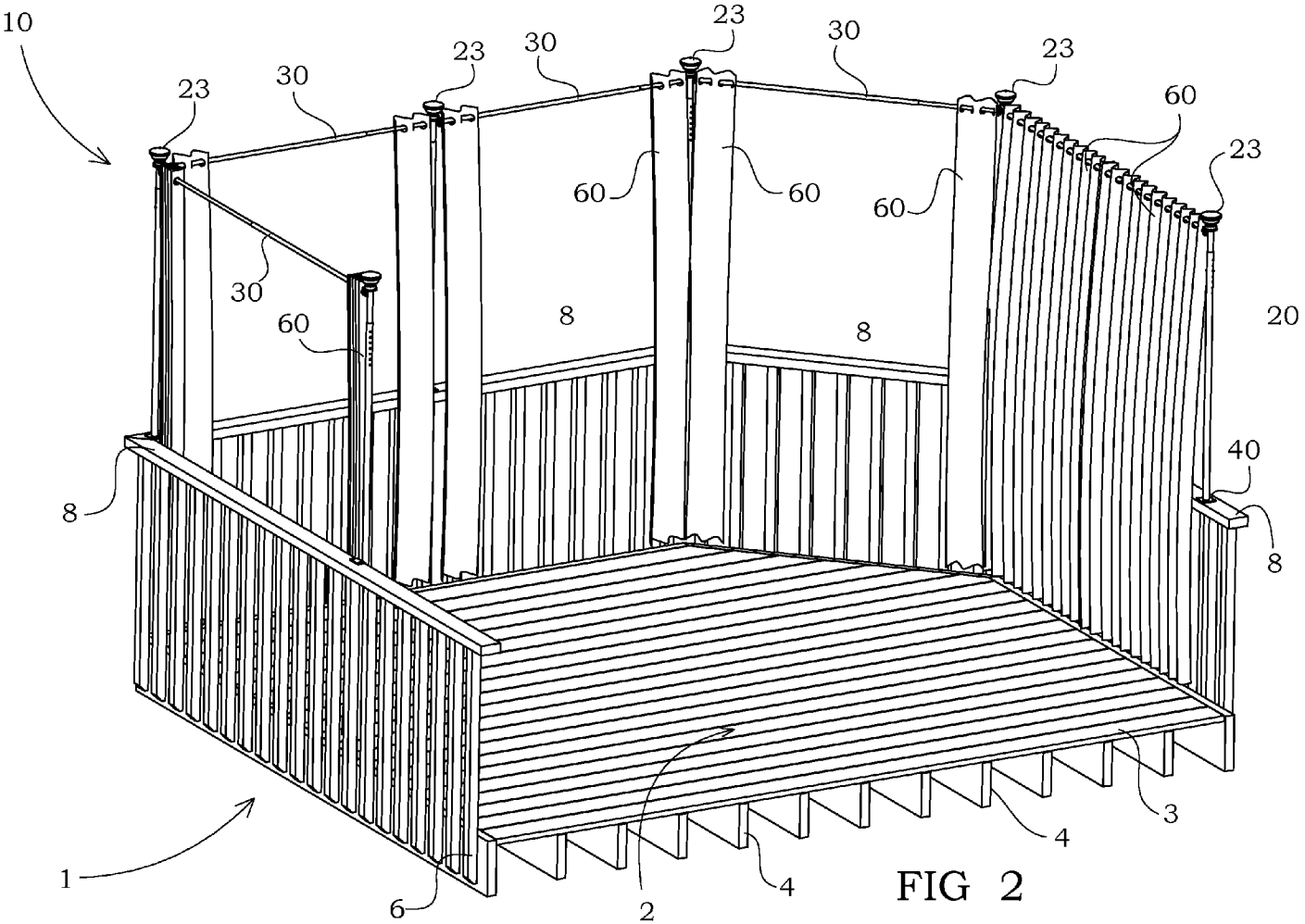
FIG. 2 is perspective overview of one embodiment of the deck curtain system 10 disclosed enclosing a deck 1 with a set of curtains around an exterior deck.
Figure 2A:
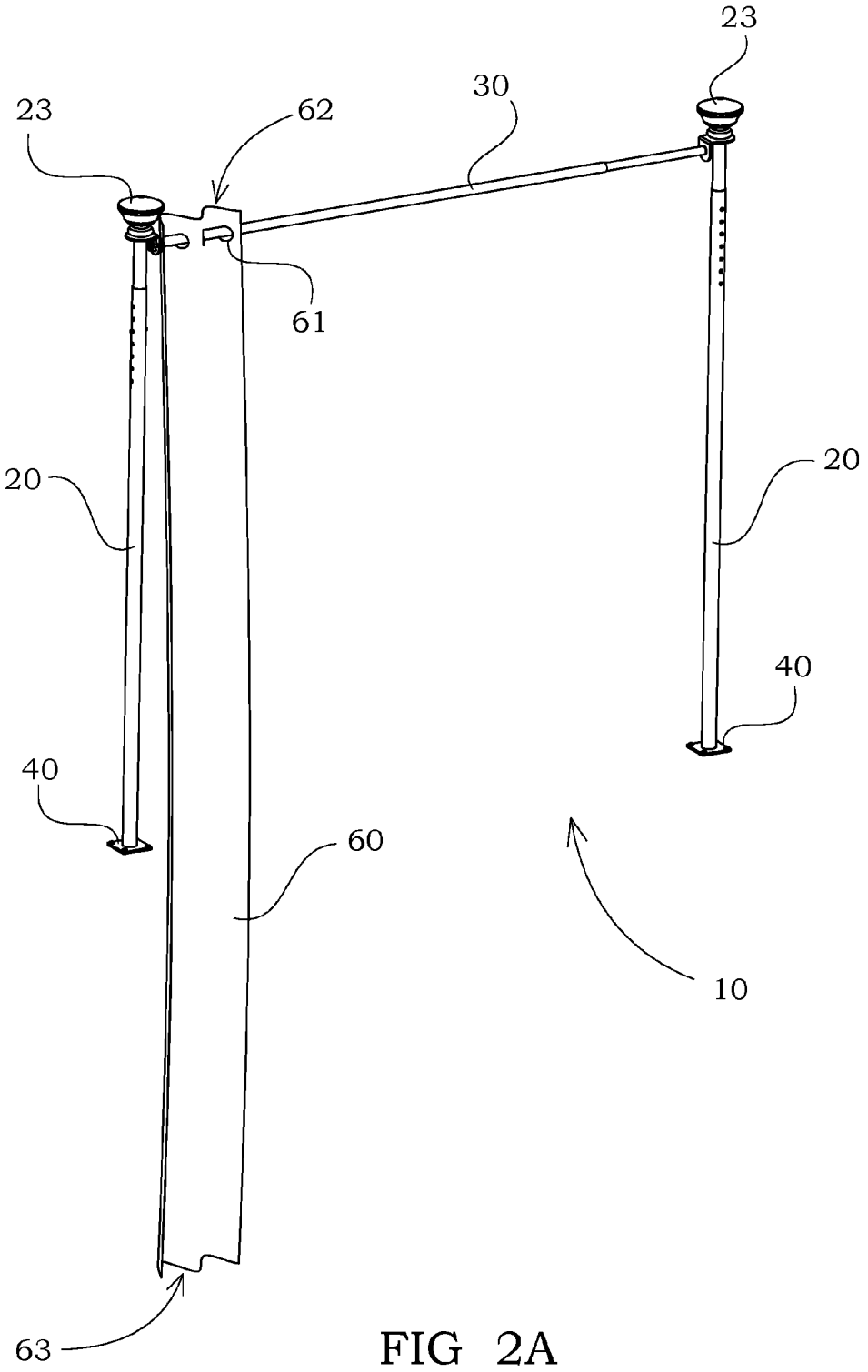
FIG. 2A is a perspective view of one section of the deck curtain system as implemented to a deck rail cap 8 surrounding a deck 1.

FIG. 2 is perspective overview of one embodiment of the deck curtain system 10 disclosed enclosing a deck 1 with a set of curtains 60 around an exterior deck area 2. As shown, the deck curtain system 10 is comprised of a combination of vertical posts 20 attached to the rail cap 8 of the deck 1, via attachment bases 40, with horizontal cross bars 30 positioned between the upper portion of the vertical posts 20 upon which the curtains 60 may be hung. FIG. 2A is a perspective view of one section of the deck curtain system 10 as implemented to a deck rail cap 8 surrounding a deck 1. As disclosed, the deck curtain system 10 has an approximate total height of 6-9 feet to provide privacy and/or sun and wind protection as may be desirable to the user of the deck 1. One of ordinary skill will appreciate that the deck curtain system 10 may be configured with vertical posts 20 having other dimensions and/or additional size or heights as desirable. Accordingly, curtain 60 may have a top 62 and a bottom 63 as shown as well as a entry-sleeve 61 which the cross member 30 may enter to support the curtain 60 when hung between the vertical posts 20. One of ordinary skill will appreciate that the embodiment of the curtain 60 shown through-out the various FIGS is for illustration only and variations in curtains dimensions, curtain type as well as entry-sleeve configurations herein will be obvious to those of ordinary skill in the arts without departure from the spirit and intent of the invention disclosed herein.

Figure 3:
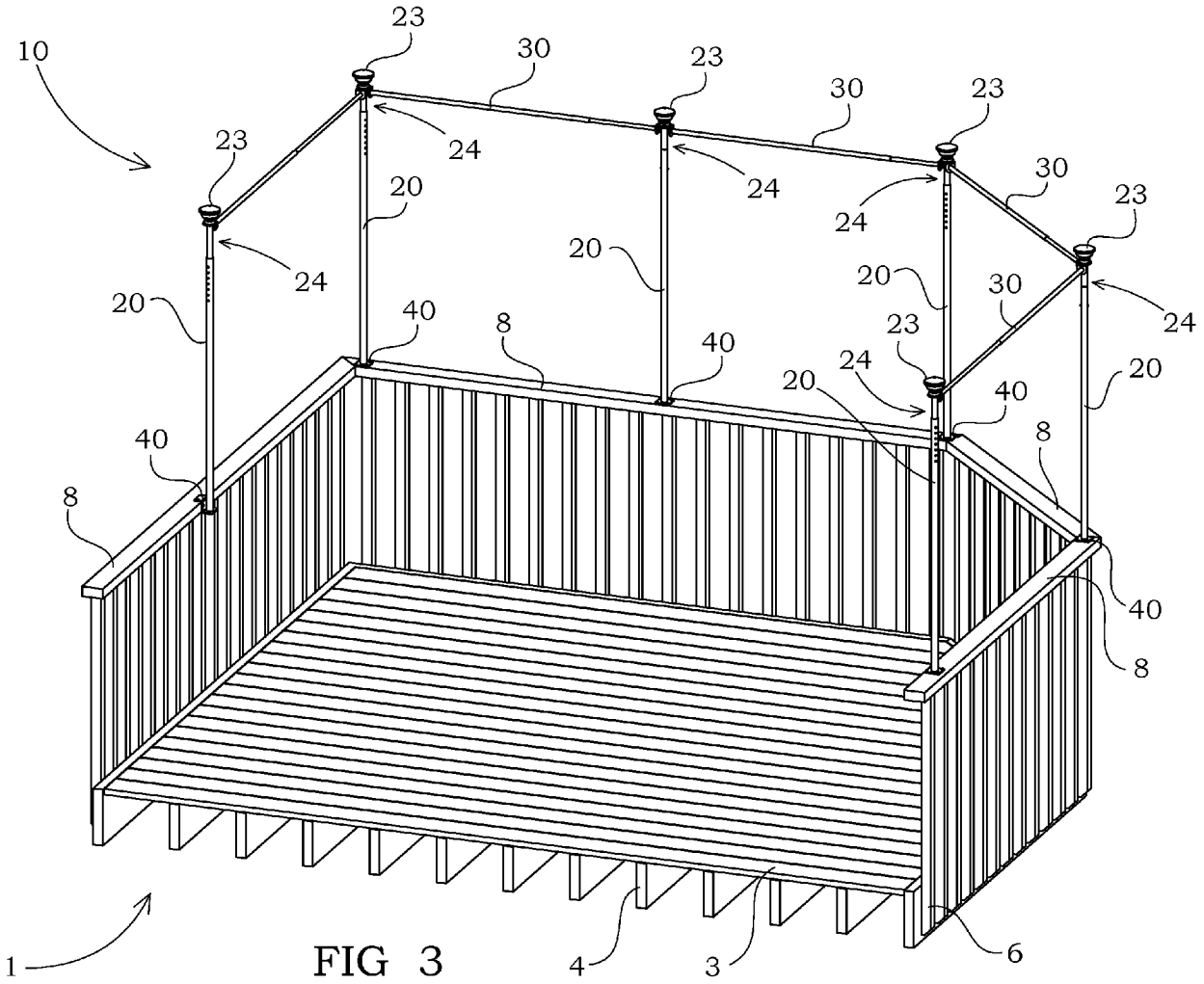
FIG. 3 is perspective view of FIG. 2 with the curtains removed to better illustrate the structural components of the deck curtain support structural components used to surround the exterior deck.

FIG. 3 is perspective view of FIG. 2 with the curtains 60 removed to better illustrate the structural components of the deck curtain support structural components used to surround the exterior deck.

Figure 4:
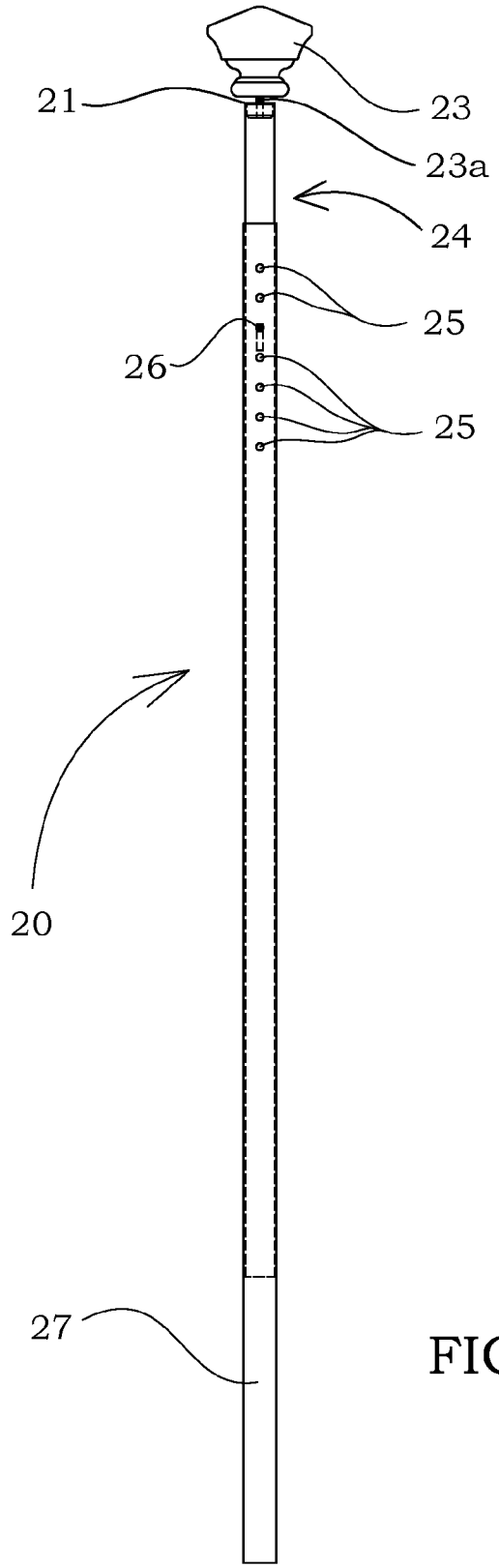
FIG. 4 is a detailed view of one illustrative embodiment of a vertical post 20 of the deck curtain system 10 disclosed herein.
Figure 4A:
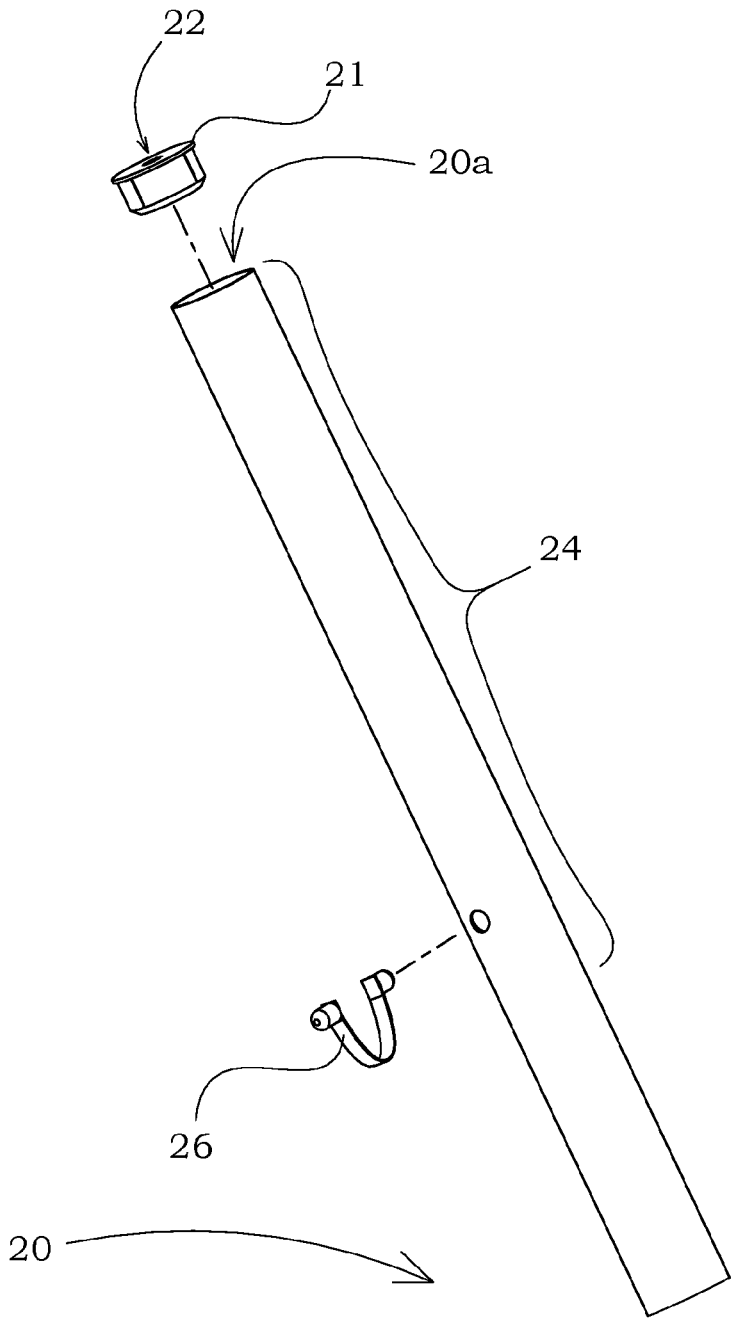
FIG. 4A is a detailed view of the end of the vertical post 20 with the finial 23 removed.

FIG. 4 is a detailed view of one illustrative embodiment of a vertical post 20 of the deck curtain system 10 disclosed herein. FIG. 4A is a detailed view of the end of the vertical post 20 with the finial 23 removed. As shown in the preceding figures, the vertical post 20 may be configured with an open end 20*a* and base end 20*b*. An end cap 21 having an opening, which may be threaded, 22 may be affixed in open end 20*a*. A finial 23, having a threaded post 23*a*, and an upper body portion having a size or shape, may be affixed to the upper most portion of the vertical post for ornamental purposes, as shown. Further, as shown in FIGS. 4 and 4A, the vertical post 20 may configured with adjustable section 24 as a second end positioned in a main section 27. The vertical post may be configured for height adjustment via holes 25 positioned in the adjustable section 24 and main section 27 with a spring button latch 26 positioned therein. As is well known to one of ordinary skill, depressing spring button latch 26 at hole 25 in a first position allows the adjustable section 24 to slide out or in across the spring button latch 26 and to a new hole at a second or third position. (Not shown) One of ordinary skill will appreciate that the embodiment of the vertical post 20 shown at FIGS. 4 and 4A is discussed in detail herein for purposes of enablement and that variations of vertical posts 20 allowing height adjustment not shown herein will be obvious to those of ordinary skill in the arts without departure from the spirit and intent of the invention disclosed herein.

Figure 5:
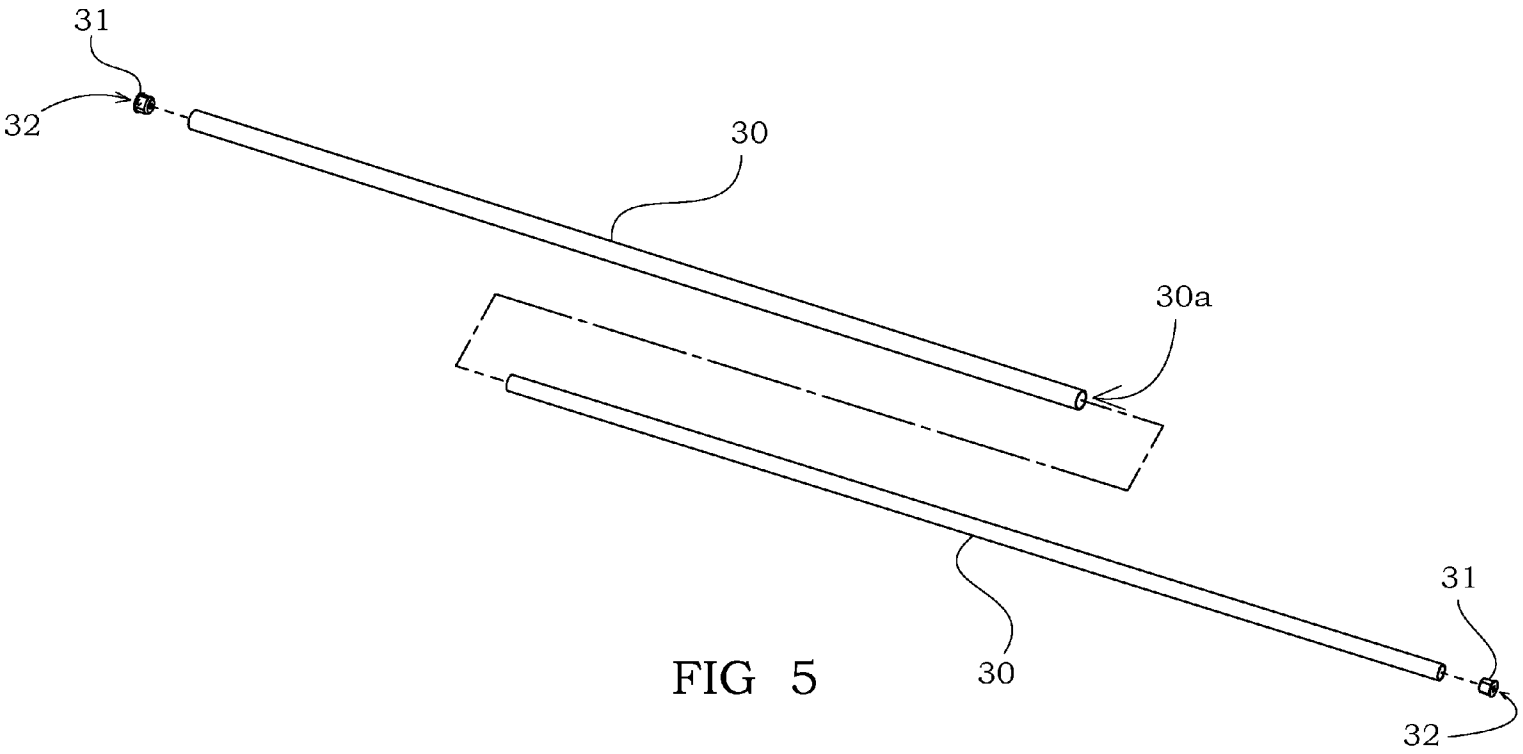
FIG. 5 is a detailed view of one illustrative embodiment of a horizontal rod 30 of the deck curtain system 10 disclosed herein.
Figure 6:
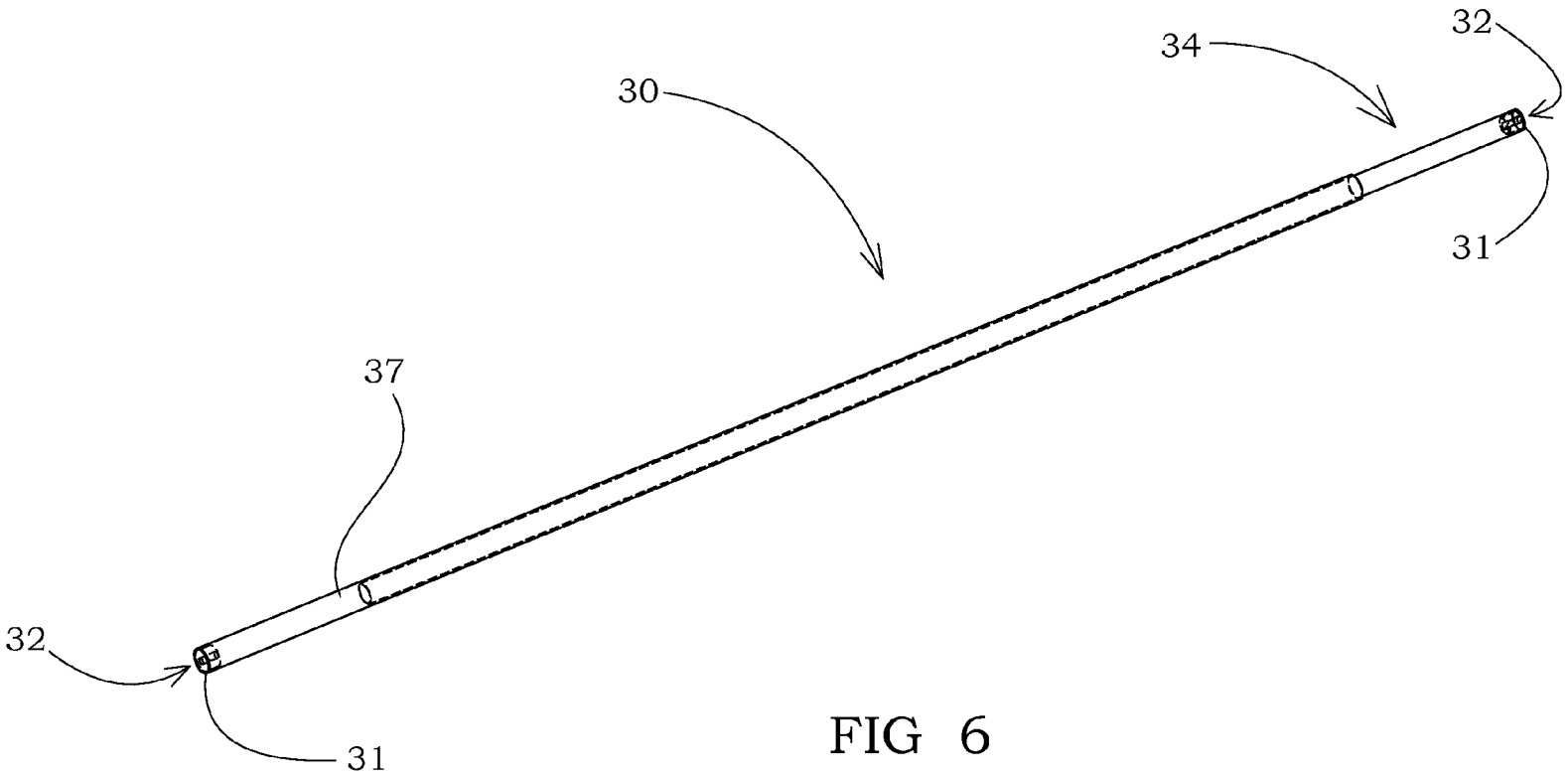
FIG. 6 is a detailed view of another illustrative embodiment of a horizontal rod 30 having a center portion 32 allowing length adjustment via telescoping ends 34 for use with the deck curtain system 10 disclosed herein.

FIG. 5 is a detailed view of one illustrative embodiment of a cross bar 30 of the deck curtain system 10 disclosed herein. Similar to vertical post 20, the cross bar 30 main body as shown is configured as hollow and having an open end 30*a* therein. An end cap 31 having a threaded opening may be positioned therein. FIG. 6 is a detailed view of another illustrative embodiment of a cross bar 30 having a center portion 32 allowing length adjustment via telescoping end sections 34 for use with the deck curtain system 10 disclosed herein. One of ordinary skill will appreciate that the embodiment of the cross member 30 shown at FIGS. 5 and 6 is discussed in detail herein for purposes of enablement and that variations of cross members 30 allowing length adjustment herein will be obvious to those of ordinary skill in the arts without departure from the spirit and intent of the invention disclosed herein.

Figure 7:
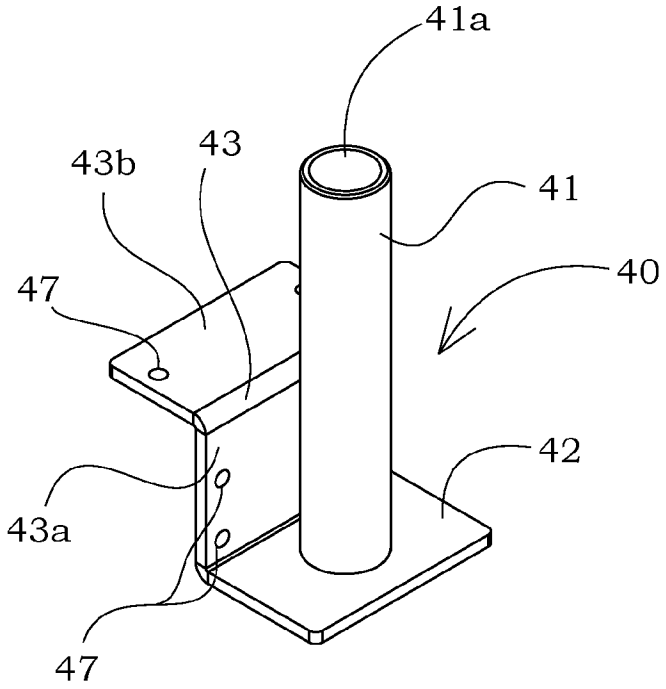
FIG. 7 is a detailed view of one illustrative embodiment of a mounting base 40 for use with vertical post 20 and the rail cap of the deck rail 8.
Figure 7A:
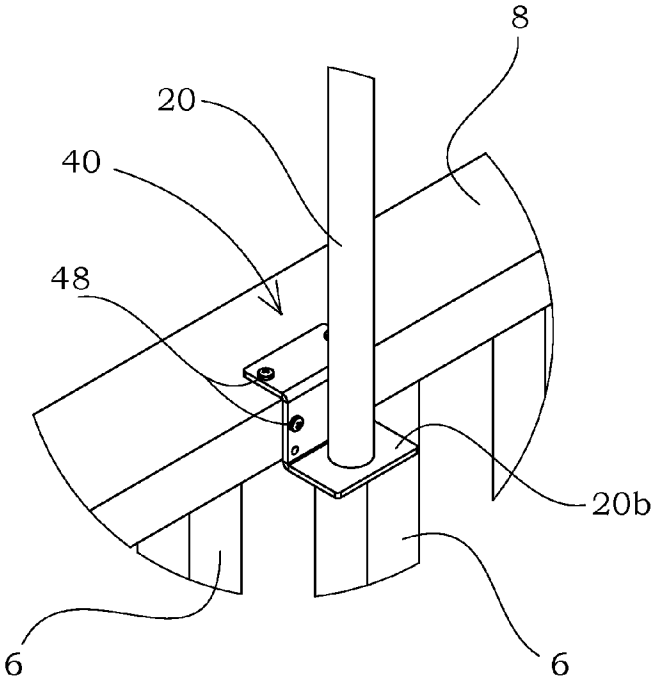
FIG. 7A is a detailed view of the embodiment of FIG. 7 attached to the rail cap 8.

FIG. 7 is a detailed view of one illustrative embodiment of a mounting base 40 which receives vertical post 20 and the rail cap 8 of the deck rail. FIG. 7A is a detailed view of the embodiment of FIG. 7 attached to the rail cap 8. As shown, the mounting base 40 has a receiver 41 which accepts the end of the vertical post 20, allowing it slide down over and cover the receiver 41. Various openings 41*a* are configured therein to allow attachment to the top and face surfaces of the rail cap 8 via fasteners 48. As shown, the base 42 of this embodiment is attached to a hanger 43 having a vertical section 43*a* and a horizontal shelf 43*b*, both of which are configured with openings 41*a* for fasteners 48.

Figure 8:
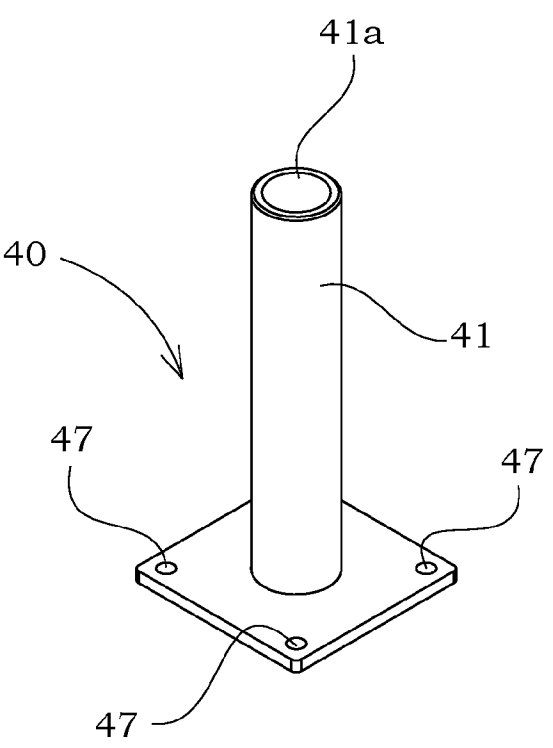
FIG. 8 is a detailed view of another illustrative embodiment of a mounting base 40 for use with vertical post 20 and the rail cap of the deck rail.
Figure 8A:
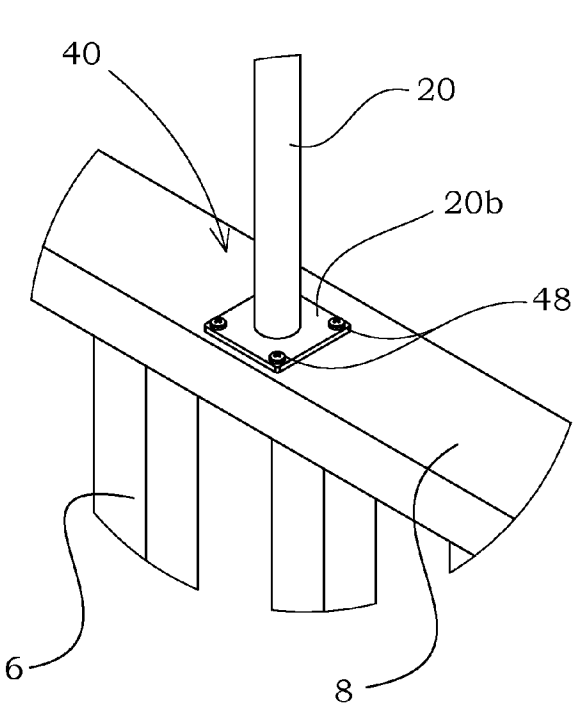
FIG. 8A is a detailed view of the embodiment of FIG. 8 attached to the rail cap 8.

FIG. 8 is a detailed view of another illustrative embodiment of a mounting base 40 for use with vertical post 20 and the rail cap of the deck rail. FIG. 8A is a detailed view of the embodiment of FIG. 8 attached to the rail cap 8. In this embodiment, the base 42 of the attachment base 40 is affixed directly to the rail cap, without hanger 43. One of ordinary skill will appreciate that the embodiments of the mounting base shown herein are for purposes of enablement and that variations of mounting bases 40 allowing either direct attachment to the top surface of the rail cap 8 or hung attachment via the top surface and face of the rail cap 8 herein will be obvious to those of ordinary skill in the arts without departure from the spirit and intent of the invention disclosed herein. The various configurations of the mounting base 40 disclosed in FIGS. 7, 7A, 8 and 8A, allow placement and attachment of the vertical posts 20 in support of installing and using the deck curtain system 10 disclosed herein.

Figure 9:
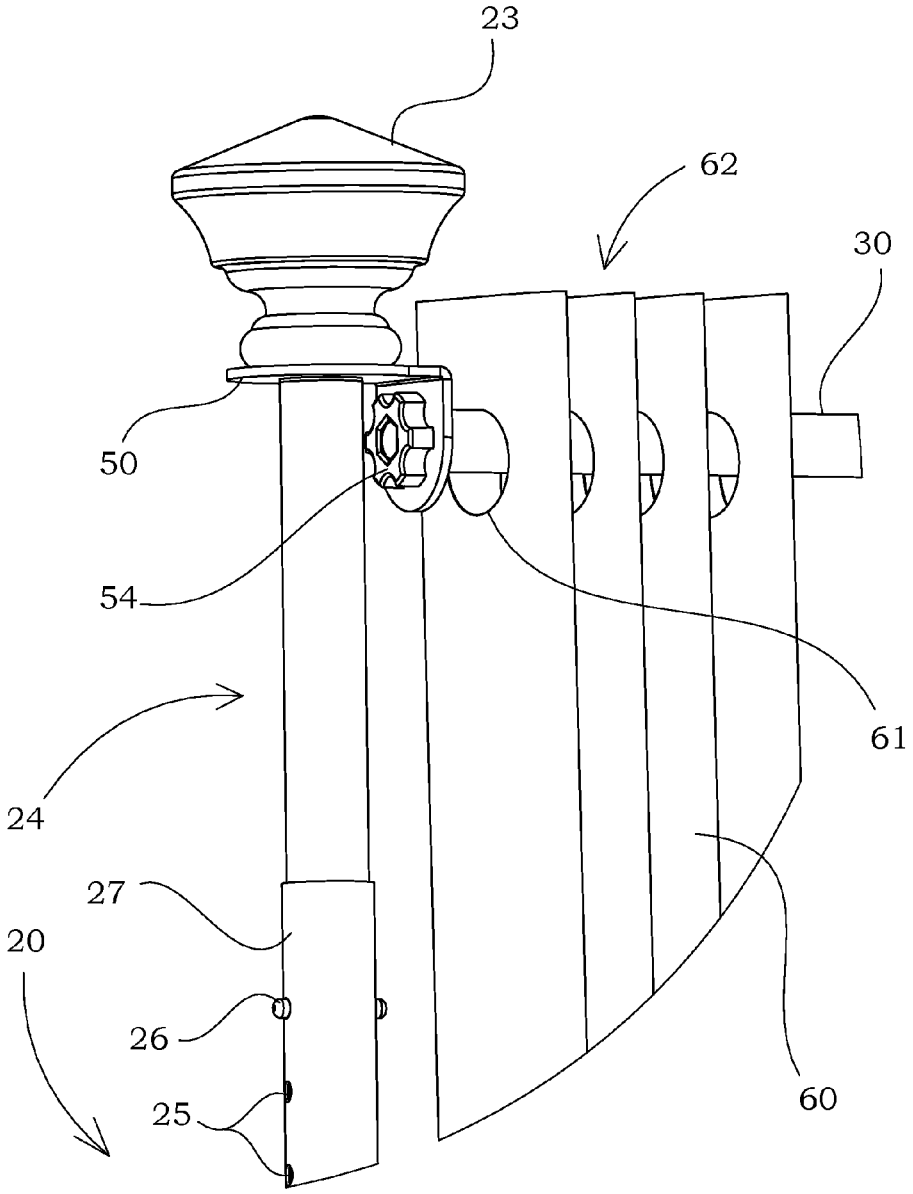
FIG. 9 is a perspective view of one illustrative embodiment of a horizontal connector 50 useful connecting in multiple sections of horizontal orientated cross bars 30 to vertical posts 20 to support the deck system 10.

FIG. 9 is a perspective view of one illustrative embodiment of a horizontal connector 50 useful in connecting in multiple sections of horizontal orientated cross bars 30 to vertical posts 20 to support the deck system 10 and curtain 60 positioned therein. Proper installation of a deck curtain system 10 onto a pre-existing deck, having any size or shape, requires the deck curtain system 10 and its components to be adjustable in height and length. The horizontal connector 50 provides a connection point between the vertical posts 20 and the horizontal cross members 30 that allows for angled variation and support of the curtain 60 hung from cross members 30 therein.

Figure 9A:
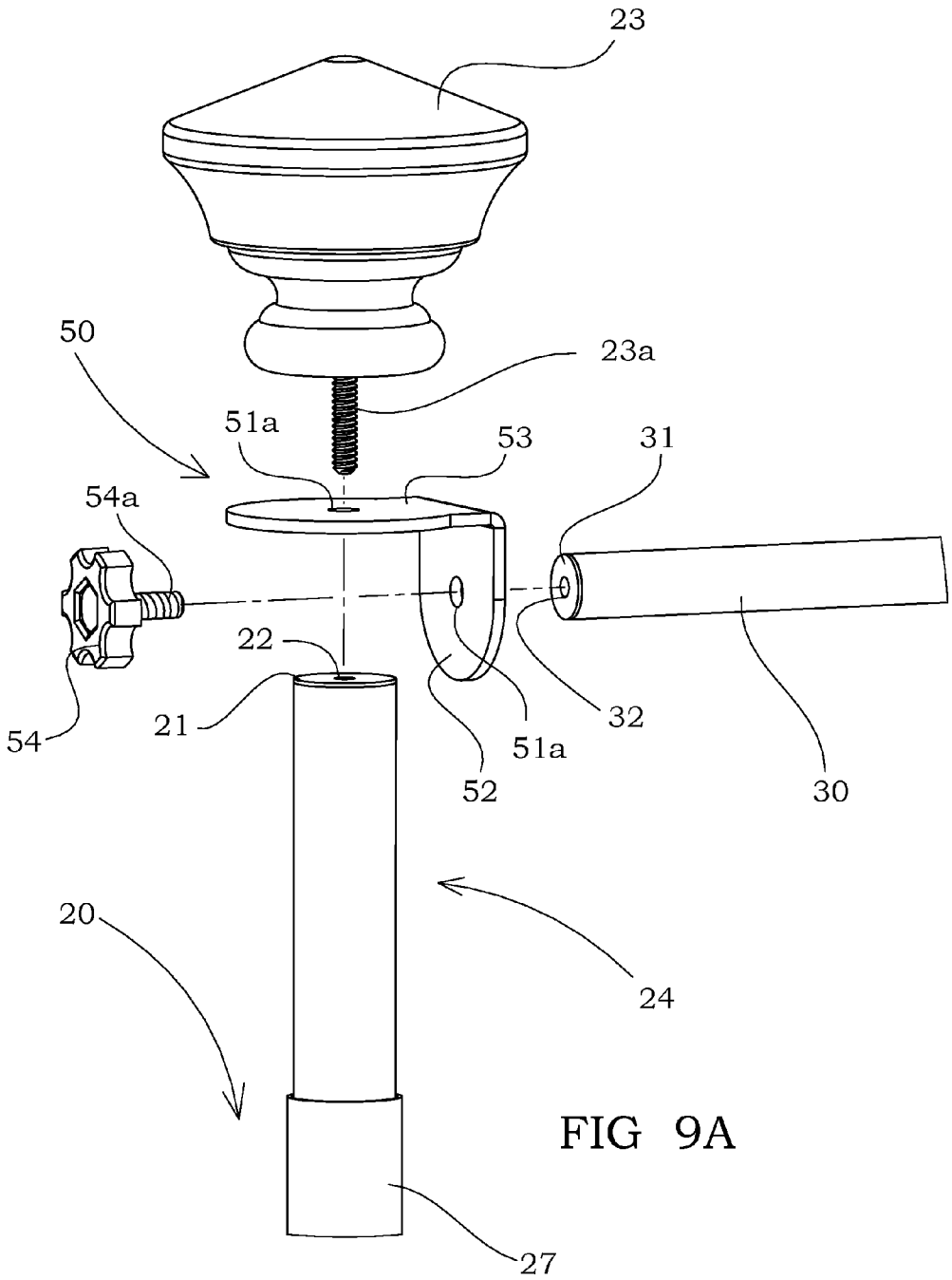
FIG. 9A is an exploded view of the horizontal connector 50 of FIG. 9.
Figure 9B:
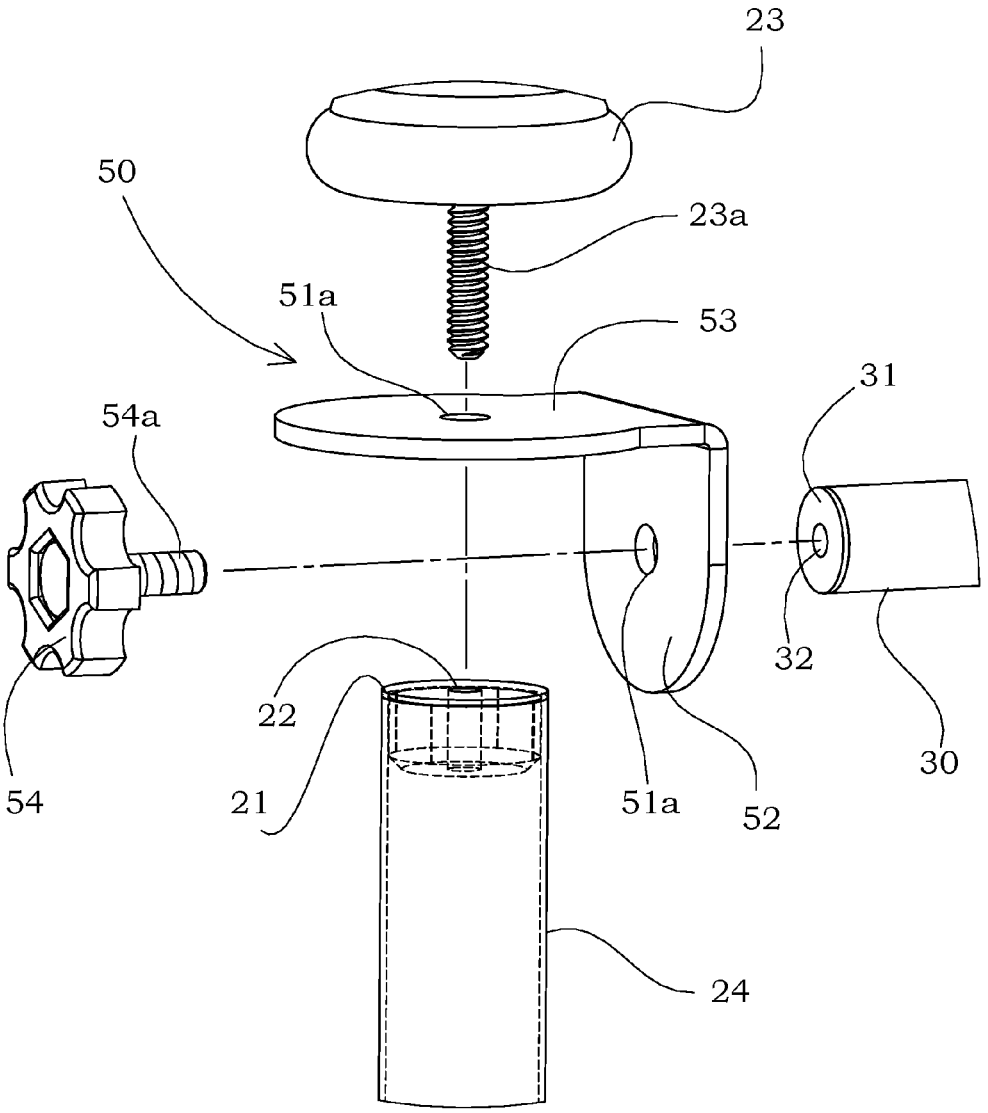
FIG. 9B is a detailed view of horizontal connector 50 of FIG. 9.

FIG. 9A is an exploded view of the horizontal connector 50 of FIG. 9 and FIG. 9B is a detailed view of horizontal connector 50 of FIG. 9. As shown, the horizontal connector 50 is comprised of a mount 51 and a flap 52, each having apertures positioned therein, 51*a* and 52*a*, respectively, which may be threaded, as shown. During assembly, and as shown, knob 54 having threaded shaft 53 therein may be inserted into and cooperatively engaged with the end of the cross member 30 via the aperture 52*a* in flap 52 to affix the horizontal connector 50 to cross member 30. Then mount 51 may be placed flat upon the end cap of the vertical post with the threaded post of finial 23 inserted into the end cap through aperture 51*a* of mount 51 to affix the horizontal connector to the vertical post 20. Mount 51 is sufficiently sized to position flap 52 a sufficient distance away from the vertical post 20 to allow knob 53 to be accessible and usable therein without interference with vertical post 20.

Figure 10A:
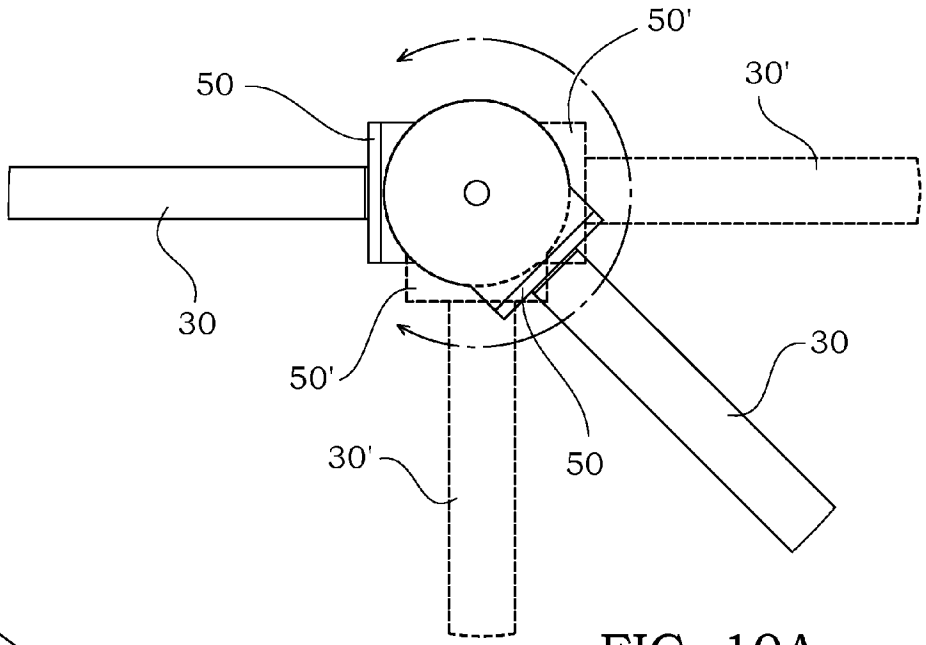
FIG. 10A is a top view illustrating how multiple horizontal connectors may be positioned upon the portion of the vertical post 20 and then rotated to an angle suitable for cross member 40.
Figure 10:
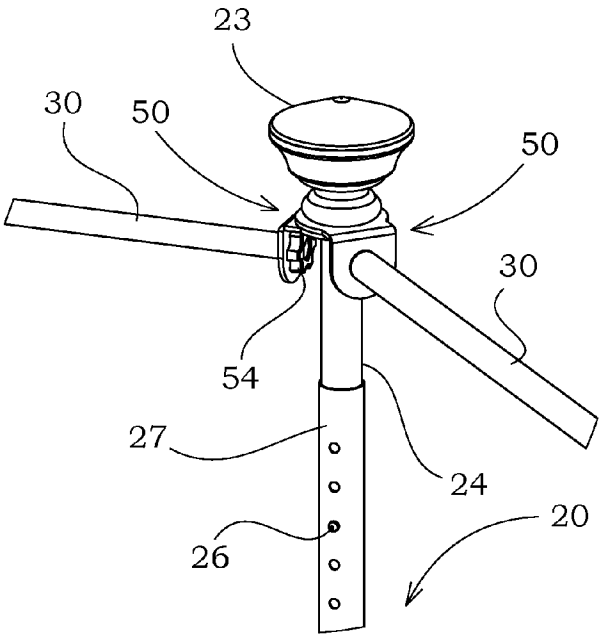
FIG. 10 is a perspective view of the top portion of a vertical post having a pair of horizontal connectors 50 engaged therein.

FIG. 10 is a perspective view of the top portion of a vertical post 20 having a pair of horizontal connectors 50 engaged therein. FIG. 10A is a top view illustrating how multiple horizontal connectors 50 may be positioned upon the upper portion of the vertical post 20. In this way, a single type of vertical post 20, in combination with one horizontal connector 50 can serve as a end post (i.e. connected to only one cross member 30) or an adjacent post (La connected to multiple cross members 30) via multiple horizontal connectors 50. Based on the proceeding figures, one of ordinary skill will appreciate that loosening the finial 23 releases the pressure on mount 51 of horizontal connector 50 allowing it to rotate in relation to vertical post 20 by comparing the position of cross member 30 to 30' and horizontal connector 50 to 50' as illustrated by FIG. 10A. Tightening finial 23 increases the pressure on mount 51 of horizontal connector 50 fixing its position in relation to vertical post 20. In this way, the horizontal connector 50 allows the deck curtain system 10 disclosed to fit or adjust to any deck to which the deck system is to be attached the perimeter of any deck as illustrated by FIG. 3 which clearly shows the deck perimeter having one ninety degree angle as well as a pair of 45 degrees angles.

Further, one of ordinary skill will appreciate that other methods and apparatus are suitable for mounting the deck curtain system as disclosed without limitation. As one of ordinary skill will appreciate the present disclosure is not limited by the means of construction or the materials chosen as any suitable materials, including plastic, steel or aluminum, and combinations therein may be used for construction and attachment of the deck curtain and supporting structure disclosed herein.

Further, the various components of the deck curtain system 10 including the vertical post 20 and cross-member 30 have diameter dimension in the range of 0.75-1.0 inch with the mounting base receiver 41 sized similarly to fit with the vertical post 20. Horizontal connector 50 is sized similarly to fit between vertical post 20 and cross member 30. In FIGS. 9-10, without limitation or restriction, mount 51 is sized to position flap 52 approximately 0.75 inches away from the vertical post 20 to allow knob 53 to be accessible and usable therein without interference with vertical post 20. The preceding dimensions are included for purposes of enablement and do not limit or restrict the breadth of the apparatus and method disclosed as one of ordinary skill will appreciate that the deck curtain and its method of use may be configured with any dimension suitable for a particular application without departure from the spirit and intent of the concepts disclosed herein.

It should be noted that deck curtain 10 and mounting structure are not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the deck curtain 10. Furthermore, variations and modifications of the foregoing are within the scope of the deck curtain and mounting system. It is understood that the deck curtain and mounting system as disclosed herein extends to all alternative combinations of one or more of the individual features mentioned, evident from the text and/or drawings, and/or inherently disclosed. All of these different combinations constitute various alternative aspects of the deck curtain and mounting system. The embodiments described herein explain the best modes known for practicing the deck curtain and mounting system and will enable others skilled in the art to utilize the same. The claims are to be construed to include alternative embodiments to the extent permitted by the prior art.

What is claimed is:

1. A deck curtain structure for use with a deck structure, said curtain structure comprising:

a) at least one pair of vertical posts, said vertical posts having a first end and a second end, wherein said first end of each said at least one pair of vertical posts is adapted to connect to a rail cap of said deck structure;

b) at least one pair of horizontal connectors, wherein said at least one pair of horizontal connectors is affixed to said second end of each of said at least one pair of vertical posts, wherein each said horizontal connector is rotatable in relation to the outer perimeter of each of said at least one pair of vertical posts, wherein each said horizontal connector of said least one pair of horizontal connectors further comprises:

i) a mount affixable to said second end of each said vertical post of said at least one pair of vertical posts, said mount having an aperture therein; and, ii) a flap connected to said mount, said flap having an aperture therein, wherein said flap extends axially down a portion of the length of each said vertical post of said at least one pair of vertical posts upon which said mount is affixed;

c) at least one cross member positioned between said at least one pair of vertical posts, wherein said at least one cross member has a first and a second end, wherein said at least one cross member is positioned between and affixed to said at least one pair of horizontal connectors; and, d) at least one curtain, wherein said at least one curtain is engaged with said at least one cross member positioned between said at least one pair of vertical posts, wherein said at least one curtain is proximate said deck structure.

2. The curtain structure for use with a deck structure according to claim 1 wherein the height of each said at least one pair of vertical posts is adjustable.

3. The curtain structure for use with a deck structure according to claim 1 wherein the length of said at least one cross member is adjustable.

4. The curtain structure for use with a deck structure according to claim 1 wherein a plurality of said at least one pair of horizontal connectors are affixed to a plurality of said at least one pair of vertical posts.

5. The curtain structure for use with a deck structure according to claim 1 wherein said first end of each said vertical post of said at least one pair of vertical posts is affixed to a mounting base adapted to connect to said rail cap of said deck structure.

6. The curtain structure for use with a deck structure according to claim 5 wherein said mounting base is adapted to connect to a top and a face of said rail cap of said deck structure.

7. A method of shading or securing the privacy of a deck area comprising:

a) attaching at least one pair of vertical posts to a rail cap of a deck structure surrounding a deck area, each said vertical post having a first end and a second end, wherein said first end of each said vertical post is attached to the rail cap of said deck structure;

b) attaching at least one pair of horizontal connectors to said at least one pair of vertical posts, wherein each horizontal connector of said at least one pair of horizontal connectors includes a mount affixable to said second end of each said vertical post of said at least one pair of vertical posts, said mount having an aperture with a flap connected to said mount, said flap having an aperture therein;

c) wherein said at least one pair of horizontal connectors is attached to said second end of each of said at least one pair of vertical posts, wherein said flap of said mounts extends axially down a portion of the length of each said vertical post of said at least one pair of vertical posts upon which said mount may be affixed, wherein each said horizontal connector is rotatable in relation to the outer perimeter of each of said at least one pair of vertical posts;

d) attaching at least one cross member between said at least one pair of vertical posts, wherein said at least one cross member has a first and a second end, wherein each said cross member is positioned between and affixed to said at least one pair of horizontal connectors; and, e) positioning at least one curtain upon said at least one cross member positioned between said at least one pair of vertical posts, wherein said at least one curtain is proximate said the deck structure.

8. A deck curtain structure for use with a deck structure, said curtain structure comprising:

a) at least one pair of vertical posts, said vertical posts having a first end and a second end, wherein said first end of each said at least one pair of vertical posts is adapted to connect to a rail cap of a deck structure;

b) At least one pair of horizontal connectors, wherein said at least one pair of horizontal connectors is affixed to said second end of one of said at least one pair of vertical posts, wherein each said horizontal connector of said at least one pair of horizontal connectors is rotatable in relation to the outer perimeter of each of said least one pair of vertical posts, wherein each said horizontal connector of said least one pair of horizontal connectors further comprises:

i) A mount affixable to said second end of each said vertical post of said at least one pair of vertical posts, said mount having an aperture therein; and, ii) A flap connected to said mount, said flap having an aperture therein, wherein said flap extends axially down a portion of the length of each said vertical post of said at least one pair of vertical posts upon which said mount is affixed c) at least one cross member positioned between said at least one pair of vertical posts, wherein said at least one cross member has a first end and a second end, wherein said cross member is positioned between and affixed to said at least one pair of horizontal connectors; and, d) at least one curtain, wherein said at least one curtain is engaged with said at least one cross member positioned between said at least one pair of vertical posts, wherein said at least one curtain is proximate said deck structure.

9. The curtain structure for use with a deck structure according to claim 8 wherein the height of said at least one pair of vertical posts is adjustable.

10. The curtain structure for use with a deck structure according to claim 8 wherein the length of said at least one cross member is adjustable.

11. The curtain structure for use with a deck structure according to claim 8 wherein a plurality of said at least one pair of horizontal connectors are affixed to a plurality of said at least one pair of vertical posts.

12. The curtain structure for use with a deck structure according to claim 8 wherein said first end of said at least one pair of vertical posts is affixed to a mounting base configured for attachment to said rail cap of said deck structure.

13. The curtain structure for use with a deck structure according to claim 12 wherein said mounting base is adapted to connect to a top and a face of said rail cap of said deck structure.

* * * * *